US005887945A

United States Patent [19]

Sedlack

[11] Patent Number: 5,887,945

[45] Date of Patent: Mar. 30, 1999

[54] INFANT SEAT

[75] Inventor: Mark A. Sedlack, Cuyahoga Falls, Ohio

[73] Assignee: Summit International, Ltd., Cleveland, Ohio

[21] Appl. No.: 954,178

[22] Filed: Oct. 20, 1997

[51] Int. Cl.[6] ..... A47C 3/00; A47D 13/10

[52] U.S. Cl. ..... 297/296; 297/258.1; 297/DIG. 11; 297/294; 280/47.25; 280/47.41

[58] Field of Search ..... 297/285, 296, 297/294, 295, 297, 440.2, 440.21, 258.1, 260.1, DIG. 11; 5/655; 280/47.25, 47.41

[56] References Cited

U.S. PATENT DOCUMENTS

| | | | |
|---|---|---|---|
| 2,927,628 | 3/1960 | Gill | 297/297 |
| 3,017,220 | 1/1962 | Chernivsky | 297/DIG. 11 |
| 4,553,786 | 11/1985 | Lockett, III et al. | 297/DIG. 11 |
| 4,976,494 | 12/1990 | Polley | 297/296 |
| 5,187,826 | 2/1993 | Mariol | 297/295 |
| 5,411,315 | 5/1995 | Greenwood | 297/DIG. 11 |

*Primary Examiner*—Peter M. Cuomo
*Assistant Examiner*—Anthony D. Berfield
*Attorney, Agent, or Firm*—Renner, Kenner, Greive, Bobak, Taylor & Weber

[57] ABSTRACT

An infant seat consists of collapsible and intersecting frame members providing for a substantial base to accommodate elevation of an infant maintained therein. One of the frame members is articulated with the two pieces thereof being interconnected by a spring such that the seat itself may be caused to reciprocate or "rock." Wheels at one end of the base accommodate ease of movement of the infant seat. A toy bar is adapted for selective interconnection with the frame for the presentation of an array of toys over the infant. The frame members are collapsible upon themselves for ease of storage.

14 Claims, 3 Drawing Sheets

INFANT SEAT

CLASS REFERENCE TO RELATED APPLICATION

Applicant claims priority based on provisional application number 60/029,259, filed Oct. 25, 1996.

TECHNICAL FIELD

The invention herein resides in the art of child care apparatus and, more particularly, to infant seats. Specifically, the invention relates to an infant seat having an articulated frame with interposed springs to allow for reciprocating motion of the seat to provide for "rocking" of an infant. The infant seat is of the type which is collapsible for storage, easily maneuverable, and adapted for selectively receiving an array of toys to entertain the infant placed therein.

BACKGROUND ART

Infant seats have been well known for many years for receiving and maintaining babies or infants in a recumbent or reclined position. Typically, infant seats are of a compact nature and are adapted for positioning near a parent or other care giver such that attention may be periodically given to the infant. Previously known infant seats are generally of fixed construction, not given to ease of maneuverability, positioning, or storage. Typically, known infant seats do not incorporate means for reciprocating the seat to provide a "rocking" motion to the infant——such a motion being known to calm or sooth an otherwise disquieted child. While some infant seats have been known to have some means for attaining a "rocking" motion, such structures have typically included a seat frame which itself is of a spring construction or has a curvilinear base. Previously known infant seats have occasionally included toys on a fixed bar or rod passing over the seat in close proximity to the infant. However, it has not been known to provide a toy bar which may be easily attached to or removed from the infant seat frame on an as-desired basis. Moreover, known infant seats typically do not incorporate a storage receptacle as a portion thereof for receiving bottles, diapers, toys, and the like.

In the prior art, infant seats were typically of a low profile. Accordingly, for the parent or care giver to have easy access to the infant, the infant seat was often placed on a table or counter top——an undesirable situation.

There is presently a need in the art for an infant seat which is given to ease of movement, positioning, and storage. There is a further need for an infant seat which is stable, yet capable of reciprocation to provide a "rocking" action, and which accommodates an easily attachable toy bar while providing a storage area. Moreover, there is a particular need in the art for an infant seat by which the infant is elevated with the unit maintained on the floor.

DISCLOSURE OF INVENTION

In light of the foregoing, it is a first aspect of the invention to provide an infant seat which is capable of reciprocating "rocking" action, while being both stable and secure.

Another aspect of the invention is the provision of an infant seat having a split or articulated frame, and having a spring interconnecting the frame parts to achieve a desired reciprocating action.

Still a further aspect of the invention is the provision of an infant seat having wheels to provide for ease of mobility.

Yet a further aspect of the invention is the provision of an infant seat which includes a positionable and removable toy bar.

Another aspect of the invention is the provision of an infant seat which serves to elevate an infant placed therein to an easily accessible level when the unit is on a floor surface.

Still a further aspect of the invention is the provision of an infant seat which is easily collapsible for storage.

An additional aspect of the invention is the provision of an infant seat having a storage receptacle maintained by the frame thereof.

Still another aspect of the invention is the provision of an infant seat which is reliable and durable in use, while being easily constructed using state of the art parts and techniques.

The foregoing and other aspect of the invention which will become apparent as the detailed description proceeds are achieved by an infant seat comprising an upper rocker frame assembly; a lower rocker frame assembly; a spring interconnecting said upper and lower rocker frame assemblies, thereby defining an articulated rocker frame assembly; a wheel frame assembly connected to said lower rocker frame assembly, said wheel frame assembly and said lower rocker frame assembly forming a base for the infant seat; a seat bottom frame connected to and extending from said upper rocker frame assembly; and a seat received and maintained by said upper rocker frame assembly and said seat bottom frame.

Still other aspects of the invention which will become apparent herein are attained by an infant seat comprising an articulated rocker frame assembly of tubular construction; spring means interposed between upper and lower sections of said rocker frame assembly and within said tubular construction, said spring means accommodating relative movement between said upper and lower sections; a seat maintained by said upper section of said rocker frame assembly; and a wheel frame assembly secured to said lower section of said rocker frame assembly, said wheel frame and said lower section of said rocker frame assembly forming a base.

BRIEF DESCRIPTION OF THE DRAWINGS

For a complete understanding of the objects, techniques, and structure of the invention reference should be made to the following detailed description and accompanying drawings wherein.

BEST MODE FOR CARRYING OUT THE INVENTION

Figure 1:
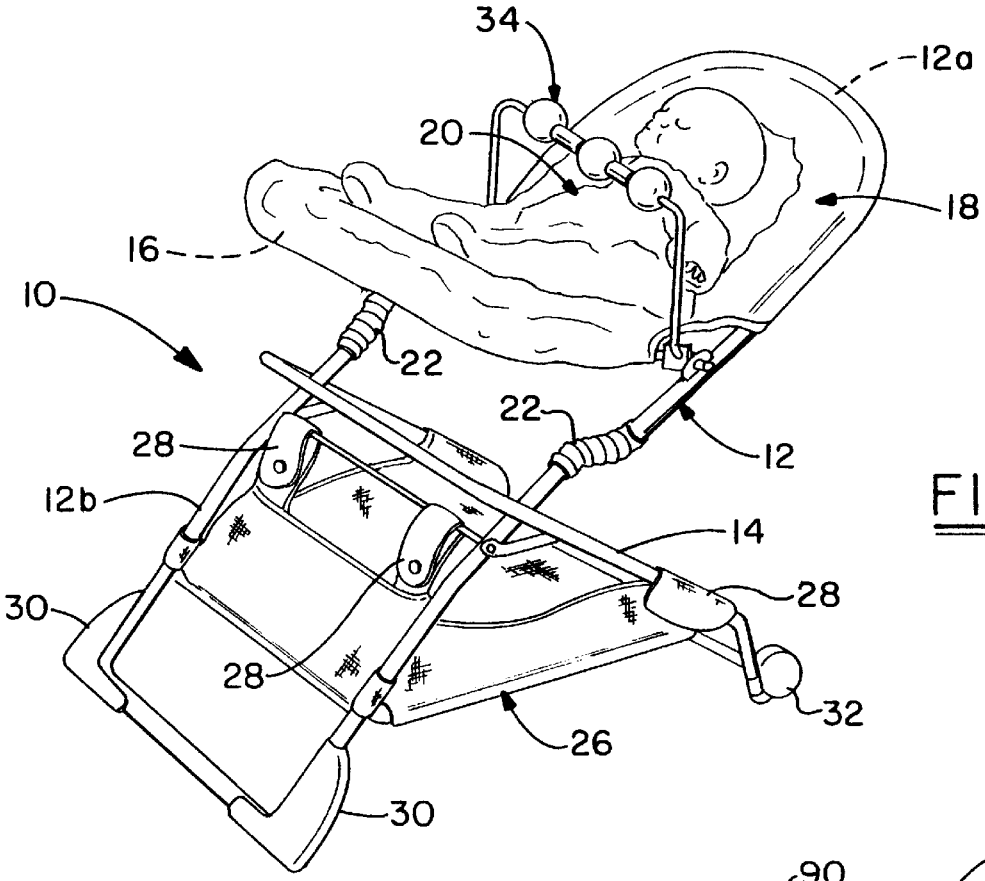
FIG. 1 is a perspective view of an infant seat according to the invention.

Referring now to the drawings and more particularly FIG. 1, it can be seen that an infant seat according to the invention is designated generally by the numeral 10. The infant seat 10 includes a rocker frame assembly 12 of an articulated nature, having an upper section 12*a* and a lower section 12*b*. The upper section 12*a* is an inverted U-shaped tubular member, while the lower section 12*b* is a rectangular shaped tubular member. The upper and lower sections of the articulated rocker frame assembly 12 are lockingly interconnected with a wheel frame assembly 14.

The upper portion of the upper section 12*a* defines a seat back frame. A seat bottom frame 16 extends therefrom, as shown. A seat 18 is fitted over the seat back frame defined by the upper section 12*a* and over the seat bottom frame 16. It will be appreciated that the seat 18 is formed from an appropriate fabric and will typically be padded for the comfort of the infant. The seat 18 fits in sleeve-like fashion over the frame members 12*a*, 16. As shown in FIG. 1, an infant 20 is held in recumbent or a partially reclined posture in the seat 18 as defined by the angled interrelation between the frame members 12*a*, 16.

Sleeves 22 extend between the upper and lower sections 12*a*, 12*b* of the rocker frame assembly 12, as shown. The sleeves 22 cover springs interconnecting the upper and lower frame sections in a manner which will be discussed later herein.

A release bar 24, discussed in detail later, is provided to attain release of the locked interengagement between the rocker frame assembly 12 and the wheel frame assembly 14. A storage bag 26 is suspended from the rocker frame assembly 12, wheel frame assembly 14, and release bar 24 by means of a plurality of loop fasteners 28. In a preferred embodiment of the invention, the loop fasteners 28 are defined by fasteners at the ends of pairs of straps or by hook and loop material at the ends thereof. The suspended storage bag 26 is provided for receiving and maintaining diapers, toys, baby bottles, and the like.

The ends of the lower section 12*b* of the rocker frame assembly 12 are provided with feet 30 extending outwardly in opposite directions therefrom. The feet 30 effectively widen the base of the rocker frame assembly 12, enhancing the overall stability of the infant seat 10. Wheels 32 are provided at the bottom ends of the wheel frame assembly 14, as shown. It will be appreciated that the wheels 32 provide for ease of maneuverability of the infant seat 10. By simply lifting the feet 30 from a supporting surface, the infant seat 10 may be rolled about upon the wheels 32. Lifting of the feet 30 may be accomplished by lifting upon the closed end of the wheel frame assembly 14 or the front of the seat bottom frame 16. A similar effect may be attained by pushing downwardly on the top of the seat back frame defined by the upper frame section 12*a*.

A toy bar 34 extends from the frame 12 at points above the interconnection of the frame 16 with the frame 12. The toy bar extends over the infant 20 and provides an attraction for the infant. As presented more fully below, the toy bar 34 is easily attached to and removed from the frame 12.

Figure 2:
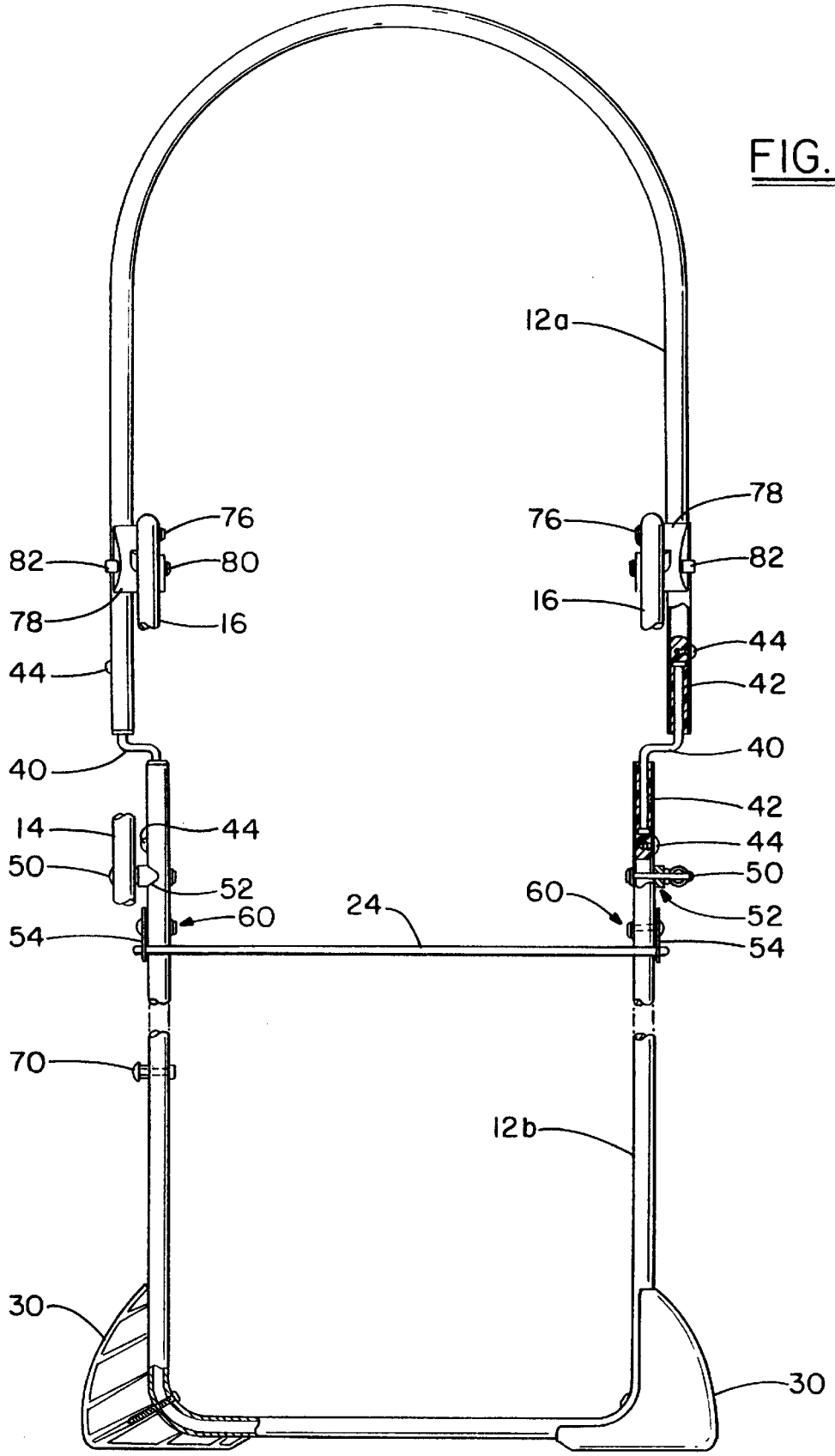
FIG. 2 is a front elevational view, in partial section, of the rocker frame assembly of the invention.

With particular reference to FIG. 2, it can be seen that the upper section 12*a* and lower section 12*b* of the rocker frame assembly 12 are interconnected by means of spring wire 40 on opposite sides of the articulated rocker frame assembly 12. Wire retainers 42 receive opposite ends of each of the spring wires 40 and are bonded or molded thereto. The wire retainers 42 are inserted into the ends of the tubular sections 12*a*, 12*b* as illustrated. Screws 44 pass through the tubular upper and lower section 12*a*, 12*b* as shown to secure the wire retainers 42, as illustrated. With the upper and lower frame sections 12*a*, 12*b* being interconnected by means of spring wires 40, the upper section 12*a* may be caused to reciprocate or "rock" with respect to the lower section 12*b*. For example, a parent or care giver need merely apply and release downward force on the top of the seat back frame in order to achieve the desired rocking motion. The widened base of the infant seat 10 accommodates the desired elevation of the infant 20 by means of the frame members 12, 14, 16 while providing sufficient stability to allow for the "rocking" action. As illustrated in FIG. 1, the spring wires 40 are enclosed by appropriate sleeves 22.

It will be appreciated by those skilled in the art that other types of spring means might be used in place of the spring wires 40. Indeed, coiled springs, leaf springs, or other suitable flexible members may be employed to interconnect the upper and lower portions of the articulated rocker frame assembly 12.

Figure 3:
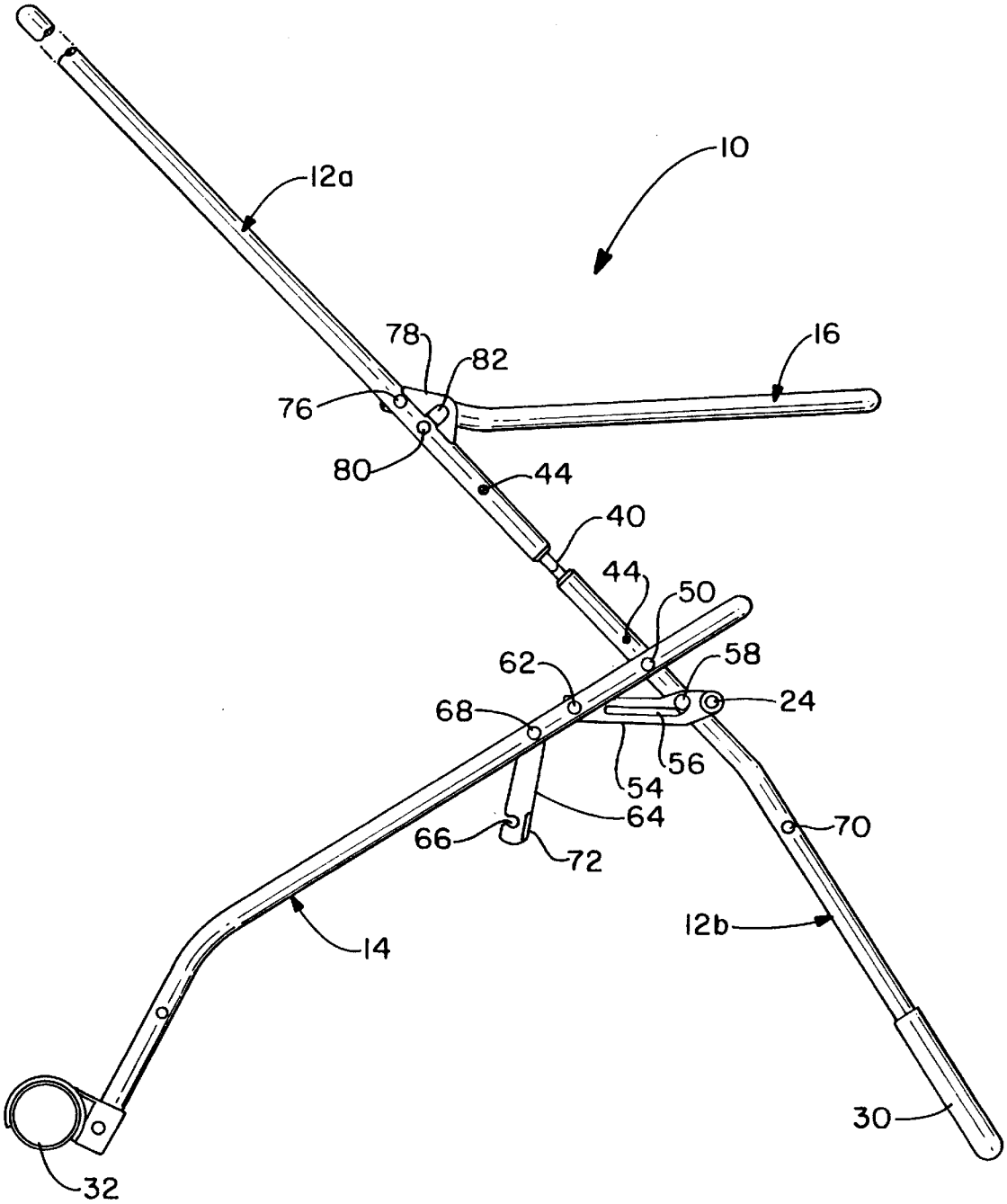
FIG. 3 is a side elevational view of the rocker, wheel, and seat frame assembly of the invention.

With reference now to FIGS. 2 and 3, it should be appreciated that the wheel frame assembly 14 is of tubular construction. Rivet pins 50, comprising portions of respective rivet pin and washer assemblies 52, pivotally retain the wheel frame assembly 14 in interconnection with the rocker frame assembly 12. A pair of lock brackets 54 interconnect the frame assemblies 12, 14, as shown. Each lock bracket 54 is characterized by an elongated slot 56 having an upwardly directed end portion, as shown. The slot 56 receives a rivet pin 58 which is part and parcel of a rivet and washer assembly 60. A rivet 62 provides a pivot point for one end of each of the lock brackets 54 at a point of interconnection with the wheel frame assembly 14. It will be appreciated that the illustration in FIG. 3 shows a lock bracket 54 in its extended and locked position, with the feet 30 and wheels 32 being separated to their maximum extent.

A lock hook 64 is pivotally connected to at least one side of the wheel frame assembly 14, as shown. The lock hook 64 is characterized by slot 66 at one end thereof and is rotatably connected to the wheel frame assembly 14 as by a rivet or other appropriate pivot pin 68. The slot 66 of the lock hook 64 is adapted to securingly engage a post 70 extending outwardly from a side of one of the legs of the bottom section 12*b* of the rocker frame assembly 12. A flange 72 extends outwardly from the lock hook 64 to facilitate manipulation thereof.

When it is desired to collapse or fold the infant seat 10 upon itself for storage or transportation, the lock hook 64 engages the post 70 to maintain the infant seat 10 in the collapsed position. In this regard, the release bar 24 is lifted upwardly such that the rivet 58 may pass from the locked end of the slot 56 to the opposite end thereof, while the frame 14 is pivoted about rivet pin 50 to collapse upon the lower frame section 12*b*. In the collapsed position, the lock hook 64 may be pivoted about the pivot pin 68 such that the slot 66 may be caused to engage the post 70 as by application of thumb pressure or the like upon the flange 72. Accordingly, the base of infant seat 10 is thereby collapsed and readied for storage or transportation.

With continued reference to FIGS. 2 and 3, it will be appreciated that the seat bottom frame 16 is a U-shaped tubular member and slightly angled at the end thereof which is supportingly interconnected with the upper frame section 12*a* of the rocker frame assembly 12. Similarly, the lower frame section 12*b* is dog-legged rearwardly in the direction of the wheels 32 such that the weight distribution of the infant seat 10, with an infant 20 therein, is substantially centrally positioned above the feet 30 and wheels 32. Hence, the stability of the infant seat 10 is attained. Moreover, the angle formed between the seat bottom frame 16 and the seat back frame of the upper section 12*a* of the rocker frame assembly 12 provides for a recumbent or partially reclined seat for the infant. With the infant so reclined and supportingly maintained centrally between the wheels 32 and feet 30, the safety of the child in the infant seat 10 is assured.

A rivet and washer assembly 76 pivotally retains the seat bottom frame 16 upon the seat back frame of the upper frame section 12*a*. A seat lock 78 is secured to the upper frame section 12*a* as by a rivet 80, or the like. The seat lock receives, supports, and locks the seat bottom frame 16 in relation to the upper frame section 12*a* in a manner well known and appreciated by those skilled in the art. The seat lock 78 includes a snap button to achieve the necessary locking feature. A release button 82 is provided in association with the seat lock 78 such that depression of the release button 80 releases the seat bottom frame 16 so that it may be pivoted about the rivet/washer assembly 76 to allow the frame 16 to fold upon the upper frame section 12*a*. It will now be appreciated that the wheel frame assembly 14 may be folded upon the lower rocker frame section 12*b* and the seat frame assembly 16 may be folded upon the upper frame section 12*a* for purposes of storing or transporting the infant seat 10.

Figure 4:
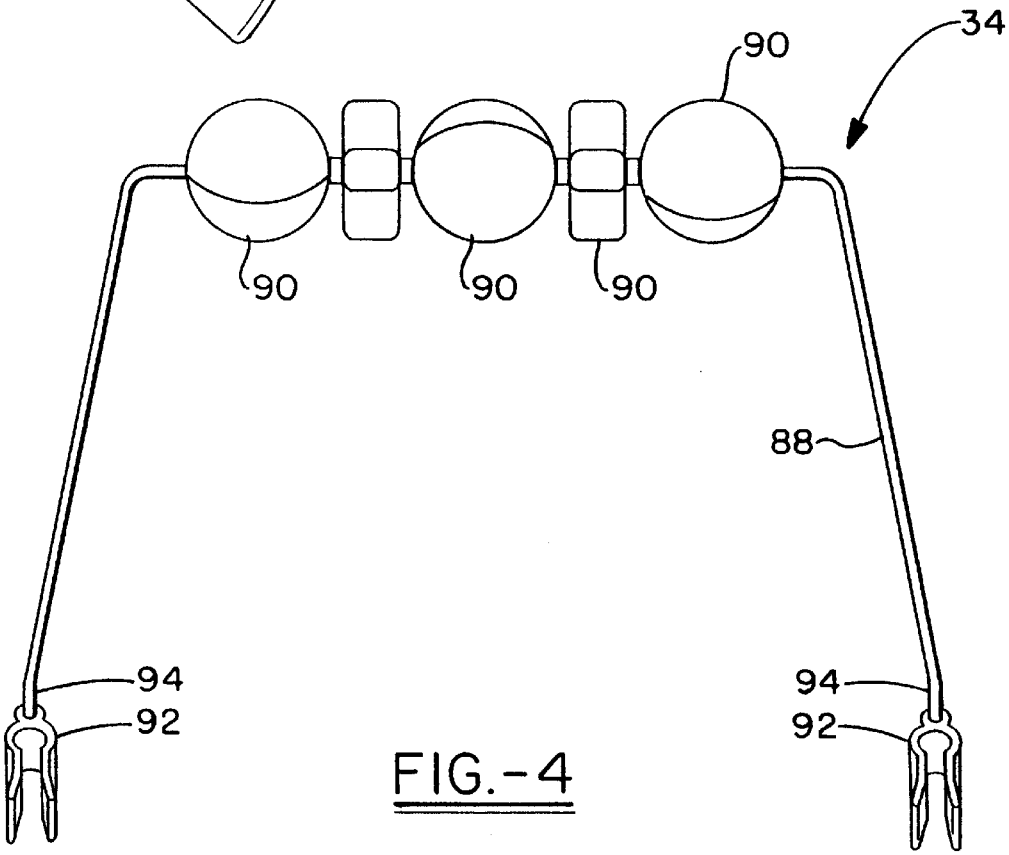
FIG. 4 is a top plan view of a clip-on toy bar for the infant seat of the invention.

As shown in FIG. 4, the toy rod 34 of the invention comprises a metal rod or wire 18 which is bent in a generally open-ended trapezoidal configuration. Toys 90 are rotatably received upon the closed end of the that configuration. Flexible clips 92 are positioned at opposite ends of a metal rod or wire 88, as illustrated. The flexible clips 92 are adapted to snap over the upper frame section 12*a* in the general area above the seat locks 78, as shown in FIGS. 2 and 3. The clips 92 thus allow the toy rod 34 to be selectively connected to or disengaged from the infant seat 10. As shown in FIG. 4, the end portions 94 receiving the flexible clips 92 are downwardly bent such that when the clips 92 are secured to the upper frame section 12*a*, the toy rod 34 extends substantially perpendicularly therefrom.

Thus it can be seen that the objects of the invention have been satisfied by the structure presented above. The infant seat 10 is stable, maneuverable, collapsible, and adapted for selected receipt and maintenance of a toy bar. Moreover, the infant seat 10 is provided with an articulated rocking frame which allows for the portion of the frame maintaining the infant to reciprocate with respect to the base thereof, to allow an infant placed therein to be "rocked."

While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims more specifically defining the invention.

What is claimed is:

1. An infant seat comprising:

an upper rocker frame assembly;

a lower rocker frame assembly;

a spring wire interconnecting said upper and lower rocker frame assemblies, said spring wire being connected to a wire retainer at each end thereof and said wire retainers being received by said upper and lower rocker frame assemblies, thereby defining an articulated rocker frame assembly;

a wheel frame assembly connected to said lower rocker frame assembly, said wheel frame assembly and said lower rocker frame assembly forming a base for the infant seat;

a seat bottom frame connected to and extending from said upper rocker frame assembly; and a seat received and maintained by said upper rocker frame assembly and said seat bottom frame.

2. The infant seat according to claim 1, wherein said upper and lower rocker frame assemblies are of tubular construction and said wire retainers are received therein.

3. The infant seat according to claim 1, wherein said seat bottom frame is secured to said upper rocker frame assembly by a rivet and washer assembly and a seat lock, allowing said seat bottom frame assembly to be selectably foldable upon said upper rocker frame assembly.

4. The infant seat according to claim 3, further comprising a seat lock securedly interconnecting said seat bottom frame and said upper rocker frame assembly to maintain said seat in a recumbent position.

5. The infant seat according to claim 4, wherein said seat comprises a first sleeve received over said upper rocker frame assembly and a second sleeve received over said seat bottom frame.

6. The infant seat according to claim 3, further comprising a toy rod releasably secured to said upper rocker frame assembly.

7. The infant seat according to claim 6, wherein said toy rod has a flexible clip at each of opposite ends thereof, said flexible clips releasably securing said toy rod to said upper rocker frame assembly.

8. An infant seat comprising:

an upper rocker frame assembly;

a lower rocker frame assembly;

a spring wire interconnecting said upper and lower rocker frame assemblies, said spring wire being connected to a wire retainer at each end thereof and said wire retainers being received by said upper and lower rocker frame assemblies thereby defining an articulated rocker frame assembly;

a wheel frame assembly pivotally connected to said lower rocker frame assembly, said wheel frame assembly and said lower rocker frame assembly forming a base for the infant seat;

a seat bottom frame connected to and extending from said upper rocker frame assembly; and a seat received and maintained by said upper rocker frame assembly and said seat bottom frame.

9. The infant seat according to claim 8, further comprising a pair of locks interconnecting said wheel frame assembly and said lower rocker frame assembly on opposite sides thereof, said locks securing said base in a fixed configuration.

10. The infant seat according to claim 8, further comprising a release bar interconnecting said pair of locks, said release bar being operative to disengage said locks to accomodate folding of said wheel frame assembly onto said lower rocker frame assembly.

11. The infant seat according to claim 10, further comprising a lock hook and post interposed between said lower rocker frame assembly and said wheel frame assembly, for securing said assemblies when folded onto each other.

12. The infant seat according to claim 10, wherein said wheel frame assembly has wheels at a bottom end thereof.

13. The infant seat according to claim 12, wherein said lower rocker frame assembly has a pair of feet at a bottom edge thereof.

14. The infant seat according to claim 13, further comprising a storage bag interposed among, and supported by, said lower rocker frame assembly, wheel frame assembly and release bar.

* * * * *